United States Patent [19]

Ishikawa

[11] Patent Number: 4,551,817

[45] Date of Patent: Nov. 5, 1985

[54] DEVICE FOR DETECTING CENTER POSITION OF TWO-DIMENSIONALLY DISTRIBUTED DATA

[75] Inventor: Masatoshi Ishikawa, Ibaraki, Japan

[73] Assignee: Director General of Agency of Industrial Science and Technology, Japan

[21] Appl. No.: 544,740

[22] Filed: Oct. 24, 1983

[51] Int. Cl.[4] ..... G06G 7/12

[52] U.S. Cl. ..... 364/811; 364/807; 364/715; 364/734

[58] Field of Search ..... 364/600, 602, 715, 723, 364/730–731, 734–735, 800, 807–808, 811, 815, 861, 300

[56] References Cited

U.S. PATENT DOCUMENTS

| | | | |
|---|---|---|---|
| 3,371,200 | 2/1968 | Funk | 364/811 X |
| 3,388,242 | 6/1968 | Johnson | 364/811 X |
| 3,410,993 | 11/1968 | Wood | 364/811 X |
| 3,443,077 | 5/1969 | Lettvin | 364/811 X |
| 3,495,081 | 2/1970 | Mensa | 364/811 X |
| 3,809,874 | 5/1974 | Pozzetti et al. | 364/811 X |
| 4,054,786 | 10/1977 | Vincent | 364/734 X |
| 4,334,223 | 6/1982 | Katagi | 364/734 X |

*Primary Examiner*—Jerry Smith
*Assistant Examiner*—Gary V. Harkcom
*Attorney, Agent, or Firm*—Pahl, Lorusso & Loud

[57] ABSTRACT

A device capable of obtaining, without data scanning by a computer, information of the center position and, if desired the total sum of two-dimensionally distributed data generated as outputs from a matrix of sensors arranged along X- and Y-axes. The device is constituted by a simple repetition of arrayed adders.

8 Claims, 13 Drawing Figures

DEVICE FOR DETECTING CENTER POSITION OF TWO-DIMENSIONALLY DISTRIBUTED DATA

BACKGROUND OF THE INVENTION

This invention relates to a device for detecting the center position of two-dimensionally distributed data such as a surface load and an optical image.

It is known in the art to detect the centroid of a surface load through arithmetic processing of signals from a multitude of sensors or detectors which are arranged in a matrix to pick up the data in the respective regions of the loaded surface. More specifically, as shown particularly in FIG. 1, a surfacewise load is applied on a matrix of p×q sensors which are arranged in the X- and Y-axes and which are adapted for generating output signals $R_{nm}$ (n and m are intergers of 1 to p and 1 to q, respectively) corresponding to the amounts of detected data. The position of centroid ($G_x$, $G_y$) is calculated on the basis of the output signals $R_{nm}$ according to the following equations.

$$G_x = \frac{\sum_{m=1}^{q} \sum_{n=1}^{p} (q - 2m + 1) R_{nm}}{\left( \sum_{m=1}^{q} \sum_{n=1}^{p} R_{nm} \right) (q + 1)} \quad (1)$$

$$G_y = \frac{\sum_{m=1}^{q} \sum_{n=1}^{p} (p - 2n + 1) R_{nm}}{\left( \sum_{m=1}^{q} \sum_{n=1}^{p} R_{nm} \right) (p + 1)} \quad (2)$$

Thus, the output signals $R_{nm}$ are read by a computer through scanning and the data are processed in accordance with a stored program to obtain the center position ($G_x$, $G_y$). The conventional apparatus, therefore, is large and expensive because of the necessity of using a computer.

BRIEF SUMMARY OF THE INVENTION

It is an object of the present invention to provide a device for measuring the center position of two-dimentionally distributed data, which is capable of instantly detecting the center position and which is relatively simple in construction and low in cost.

Another object of the present invention is to provide a device of the above-mentioned type which does not require the use of a computer operated according to a stored program and which can be constructed by means of large scale integrated circuits.

It is a further object of the present invention to provide a device of the above-mentioned type also capable of measuring the total sum of the data.

BRIEF DESCRIPTION OF THE DRAWINGS

Other objects, features and advantages of the present invention will become apparent from the detailed description of the preferred embodiments of the invention which follows, when considered in light of the accompanying drawings in which:

FIG. 3(*a*) is a circuit diagram showing an example of the adder of FIG. 3;

FIG. 6(*a*) is a circuit diagram showing an example of the adder of FIG. 6;

FIGS. 7(*a*)–7(*d*) are circuit diagrams showing examples of the adders used for the embodiment of FIG. 7.

DETAILED DESCRIPTION OF THE PREFERRED EMBODIMENTS

Figure 1:
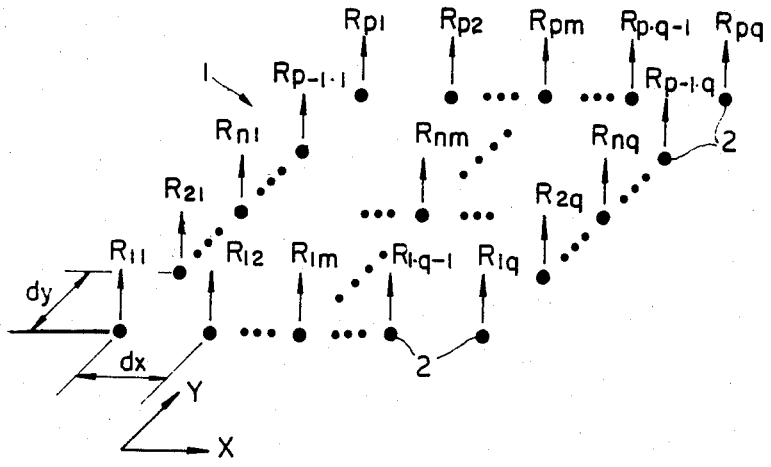
FIG. 1 is an explanatory view of a two-dimensionally arrayed matrix of sensors.

The device according to the present invention is comprised of a data detector, a data processor and an arithmetic circuit. FIG. 1 diagrammatically depicts the data detector 1 which is constituted by a matrix of p×q sensors or detectors 2 having q-number of columns in the direction of X-axis and p-number of rows in the direction of Y-axis. Each sensor 2 is adapted to generate an output signal $R_{nm}$ corresponding in amount to the amount of the data, such as load, detected. Each sensor 2 may be either of an analog type generating an output signal of analog quantity or of a digital type producing an output signal of digital quantity.

Figure 2:
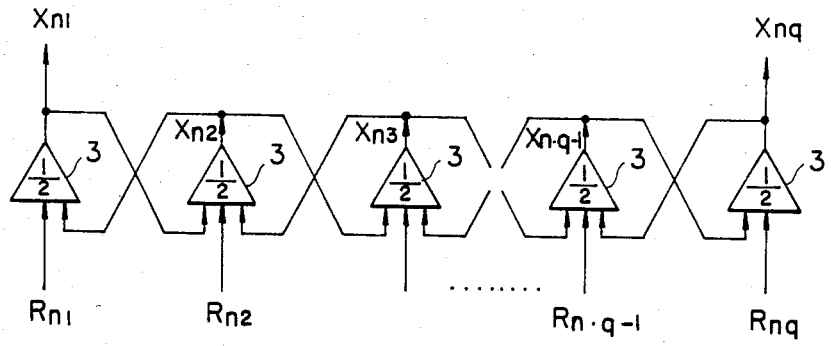
FIG. 2 is a fragmentary circuit diagram, with a combination of arrayed adders, for processing the outputs from corresponding sensors according to the present invention.

Referring to FIG. 2, there is shown part of the processing circuit to be coupled with the above-mentioned data detector 1. The processing circuit is constituted by p×q first adders 3 provided in correspondence to the p×q sensors for processing the data from the data detector 1 in the X-axis direction and another p×q second adders for processing the data in the Y-axis direction. Shown in FIG. 2 is the n-th row of the p-number of rows of the adders 3 arranged in the direction of Y-axis of the processing circuit. As seen from FIG. 2, each adder 3 receives as its input signal the output signal of a corresponding sensor 2 as well as the output signal or signals of adjacent adder or adders 3 arranged in the same row, producing an output signal corresponding to ½ of the total value of the input signals. For example, with regard to the n-th row shown in FIG. 2, the output $X_{n1}$ of the adder 3 which receives the signal $R_{n1}$ as input is expressed by:

$$X_{n1} = \tfrac{1}{2}(R_{n1} + X_{n2})$$

in which $X_{n2}$ is the output of an adder corresponding to the sensor which is located adjacent to the sensor with the output signal $R_{n1}$. Similarly, the output signals $X_{nm}$ and $X_{nq}$ from the adders which are supplied with the signals $R_{nm}$ and $R_{nq}$, respectively, are expressed by $$X_{nm} = \tfrac{1}{2}(R_{nm} + X_{n(m-1)} + X_{n(m+1)}), \text{ and}$$

$$X_{nq} = \tfrac{1}{2}(R_{nq} + X_{n(q-1)})$$

Thus, the adders corresponding to the sensors which are in the opposite end columns, namely, in the 1st and q-th columns of the sensors which are arranged in q-number of columns in the direction of X-axis, produce p-number of output signals $X_{n1}$ (in which n is an integer of 1 to p) and p-number of output signals $X_{nq}$ (in which n is an integer of 1 to p), respectively.

In a similar manner, the second adders which process the signals in the direction of Y-axis receive at the respective input terminals the output signal of a corresponding sensor as well as the output signal of an adder or adders corresponding to an adjacently located sensor or sensors in each of the q columns arranged in the direction of X-axis. For instance, with regard to the m-th column, the output signal $Y_{1m}$ of the adder which receives the signal $R_{1m}$ is expressed by $$Y_{1m}=\tfrac{1}{2}(R_{1m}+Y_{2m})$$

in which $Y_{2m}$ is an output signal from an adder corresponding to the sensor which produces an output signal $R_{2m}$. On the other hand, the output signals $Y_{nm}$ and $Y_{pm}$ of the adders which receive the signals $R_{nm}$ and $R_{pm}$, respectively, are expressed by:

$$Y_{nm}=\tfrac{1}{2}(R_{nm}+Y_{(n-1)m}+Y_{(n+1)m}) \text{ and}$$

$$Y_{pm}=\tfrac{1}{2}(R_{pm}+Y_{(p-1)m})$$

Consequently, the 1st and p-th rows of the p-number of rows arranged in the direction of Y-axis produce q-number of output signals $Y_{1m}$ (in which m is an integer of 1 to q) and q-number of output signals $Y_{pm}$ (in which m is an integer of 1 to q), respec- tively.

Figure 3:
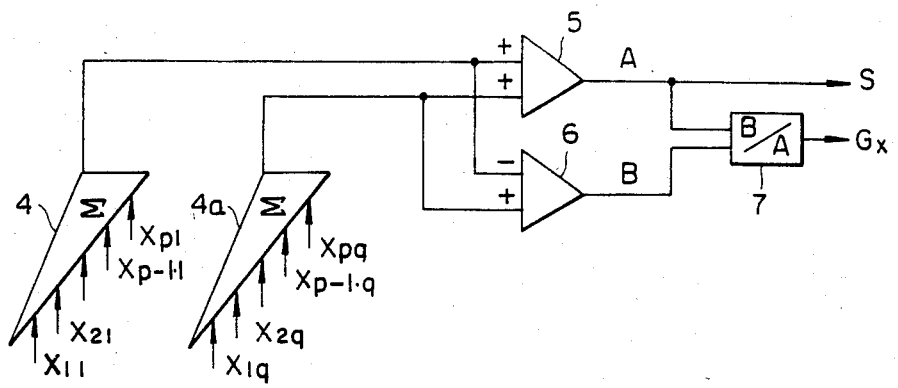
FIG. 3 is a circuit diagram receiving the outputs from the circuit of FIG. 2 for generating outputs indicative of the center position and the total sum.

As shown in FIG. 3, the arithmetic circuit which is connected in a stage subsequent to the above-described processing circuit is provided with adders 4 and 4*a* adapted to add up the output signals $X_{11}$ to $X_{p1}$ and $X_{1q}$ to $X_{pq}$ from the processing circuit and to generate the total sums $$\sum_{n=1}^{p} X_{n1} \text{ and } \sum_{n=1}^{p} X_{nq},$$

respectively. The adders 4 and 4*a* are connected to an adder 5 and a subtractor 6 which add up and subtract one from the other the output signals of the adders 4 and 4*a*, respectively, to generate outputs A $$\left(=\sum_{n=1}^{p}(X_{n1}+X_{nq})\right)$$

and B $$\left(=\sum_{n=1}^{p}(X_{nq}-X_{n1})\right),$$

respectively. The adder 5 and subtractor 6 are connected to a divider 7 which divides the output signal B of the subtractor 6 by the output signal A of the adder 5. The output signal of the divider 7 indicates the X-component $G_x$ of the coordinate of the center (centroid) position of two-dimensionally distributed data, for example, of the load as expressed by Equation (1) shown previously, while the output signal A of the adder 5 indicates the total sum S of output signals of the respective sensors 2.

Figure 3A:
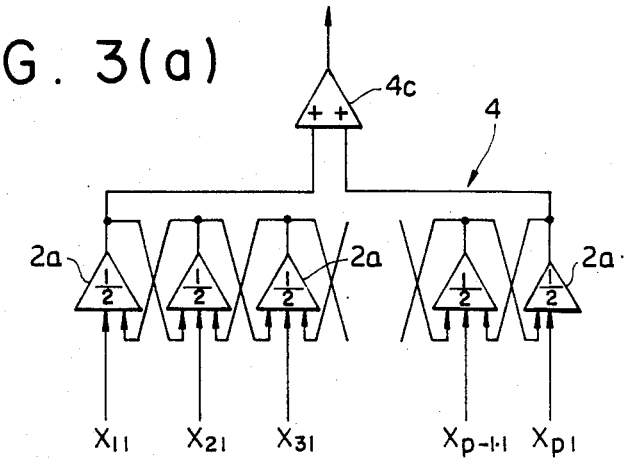

The adder 4 is preferably constituted by a circuit shown in FIG. 3*a* which has the same construction as that shown in FIG. 2 except that the circuit of FIG. 3*a* is formed of only p×1 of matrix receiving $X_{nl}$ (n=1 to p) as inputs and is additionally provided with an adder 4*c* which receives the outputs from the adders 2*a* positioned at both ends of the p×1 matrix to generate an output which is the sum $$\sum_{n=1}^{p} X_{n1}.$$

The adder 4*a* of FIG. 3 is also constituted by the same circuit as shown in FIG. 3*a*.

In order to obtain the Y-component $G_y$ of the coordinate of the center position, an arithmetic circuit (not shown) similar to FIG. 3 is provided. The output signals $Y_{11}$ to $Y_{1q}$ and $Y_{p1}$ to $Y_{pq}$ generated respectively from the second adders in the opposite rows are respectively added up to obtain the total sums $$\sum_{m=1}^{p} Y_{1m} \text{ and } \sum_{m=1}^{q} Y_{pm},$$

from which $G_y$ is calculated by dividing $$\sum_{m=1}^{q}(Y_{pm}-Y_{1m}) \text{ by } \sum_{m=1}^{q}(Y_{1m}+Y_{pm})$$

in the same manner as described with reference to FIGS. 3 and 3*a*. The calculated value is identical with that expressed by Equation (2).

It is to be noted that, in the foregoing embodiment, the q-number of columns of the sensors 2 must be spaced with the same distance $d_x$ with each other in the direction of X-axis and the p-number of rows in the direction of Y-axis must also be equally spaced with each other with a distance $d_y$. The distances $d_x$ and $d_y$ may be of the same or different values. The coordinates ($G_x$, $G_y$) of the centroid are indicated in relation with the center of the sensor matrix, namely, in terms of coordinates on the rectangular X-Y coordinates having the origin at $$\left(\frac{1+q}{2}, \frac{1+p}{2}\right).$$

Figure 4:
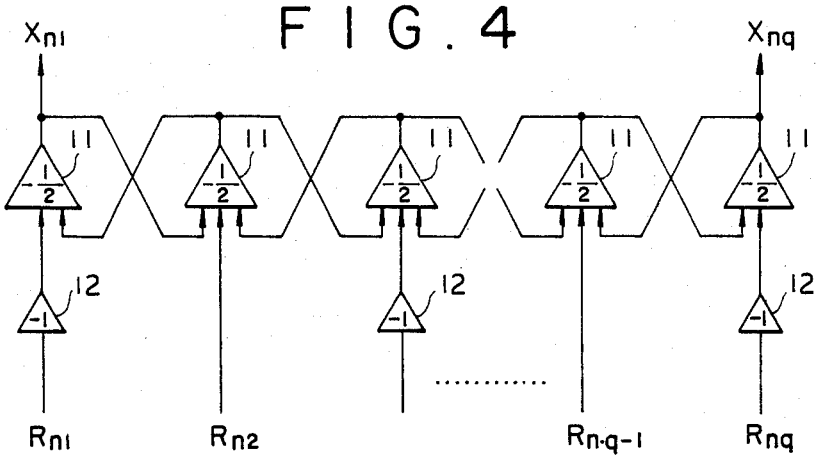
FIG. 4 is a circuit diagram similar to FIG. 2 showing an alternate embodiment of FIG. 2.

FIG. 4 illustrates a modification of the embodiment shown in FIG. 2, which requires a reduced scale circuit when embodied in an analog circuit. While the adders 3 are of the non-inversion type in the above-described embodiment, the modification of FIG. 4 employs adders 11 of the inversion type each generating as its output signal $-\frac{1}{2}$ of the sum of the input signals. As shown in FIG. 4, the output signals of the sensors in the columns of odd numbers are fed to corresponding adders 11 through inverting amplifiers 12. The same arrangement is employed for the processing circuits which handle the output signals of sensors in other rows arranged in the Y-axis direction and the sensors in the columns arranged in the X-axis direction. The output signals of these processing circuits are fed to an arithmetic circuit similar to FIG. 3 to calculate the coordinates ($G_x$, $G_y$) of the center (centroid) position and the total sum of the data. In this instance, $G_x$ is calculated as B/A when g is an odd number and A/B when an even number. $G_y$ is calculated as B/A when p is an odd number and as A/B when an even number.

Figure 5:
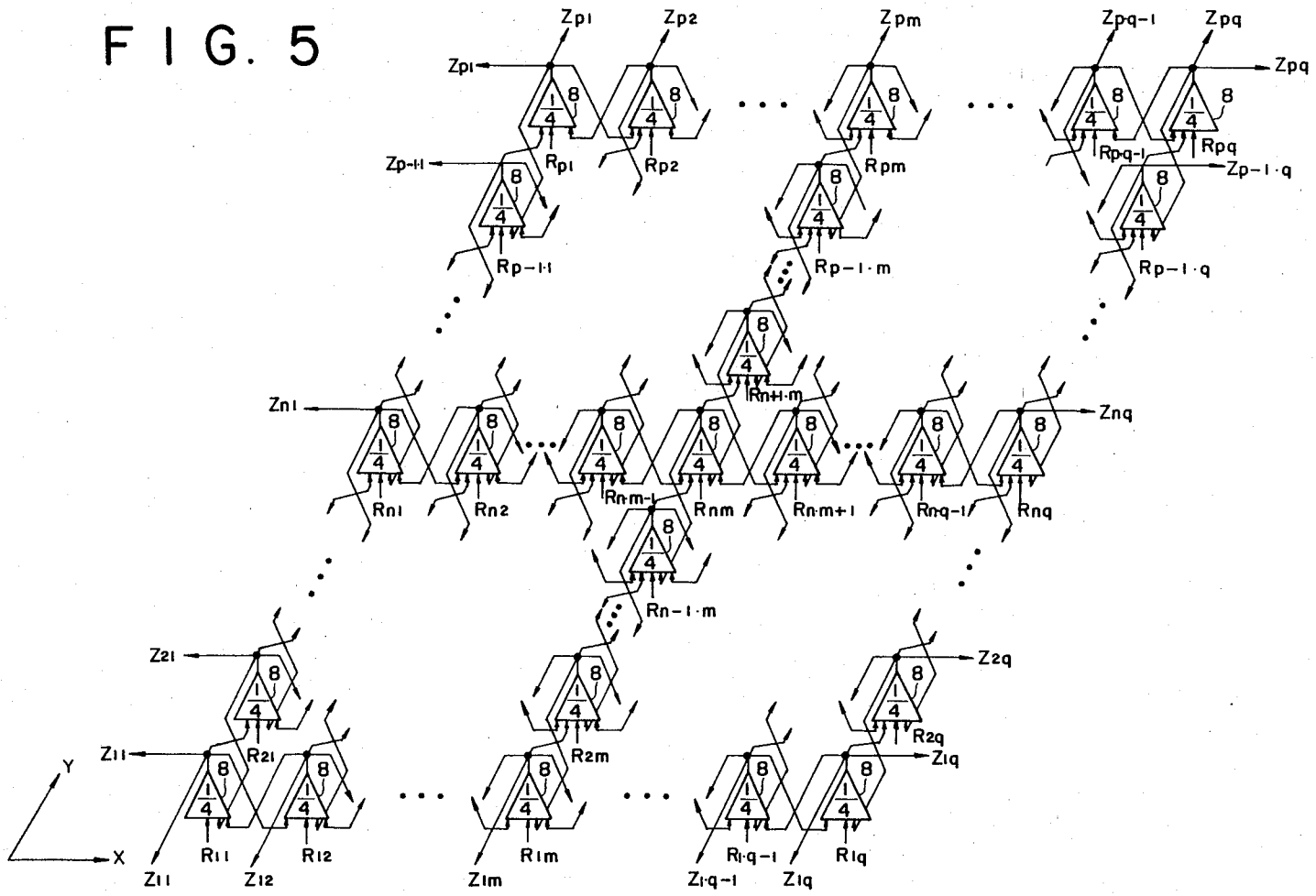
FIG. 5 is a circuit diagram showing an alternate embodiment for processing the outputs from the sensors.

The foregoing embodiment requires 2(p×q) adders in total (the total number of the first and second adders)

for processing the signals in the X- and Y-axis directions. The number of adders is reduced by half in the following embodiment shown in FIG. 5, using each adder for the processing in both the X- and Y-axis directions in common. In this case, the sensors are positioned such that the spaces $d_x$ and $d_y$ of FIG. 1 are equivalent to each other. Indicated at 8 in FIG. 5 are adders which are provided in a number corresponding to p×q sensors of FIG. 1, each receiving the output signal $R_{nm}$ of a corresponding sensor. Each one of the adders 8 receives the output signals of adders corresponding to the sensors which are located in adjacent positions in the X- and Y-axis directions and produces an output signal which is ¼ of the sum of the input signals. For instance, the output signal $Z_{11}$ of the adder which receives an output signal $R_{11}$ from a sensor is expressed by $$Z_{11}=\tfrac{1}{4}(R_{11}+Z_{21}+Z_{12})$$

wherein $Z_{21}$ and $Z_{12}$ are output signals from adders corresponding to adjacently located sensors. Similarly, the output $Z_{n1}$ of the adder which receives the output $R_{n1}$ is expressed by $$Z_{n1}=\tfrac{1}{4}(R_{n1}+Z_{n2}+Z_{(n-1)1}+Z_{(n+1)1})$$

in which $Z_{n2}$, $Z_{(n-1)1}$, and $Z_{(n+1)1}$ are output signals of the adders corresponding to the three adjacent sensors. Further the output signal $Z_{nm}$ of the adder receiving the sensor output $R_{nm}$ is expressed by $$Z_{nm}=\tfrac{1}{4}(R_{nm}+Z_{(n-1)m}+Z_{(n+1)m}+Z_{n(m-1)}+Z_{n(m+1)})$$

wherein $Z_{(n-1)m}$, $Z_{(n+1)m}$, $Z_{n(m-1)}$, $Z_{n(m+1)}$ are output signals of the adders corresponding to the sensors located adjacently on four sides of the sensor with the output $R_{nm}$.

Thus, the adders corresponding to the opposite end columns of the sensors which are arranged in q-number of columns in the direction of X-axis, namely, corresponding to the 1st and q-th columns produce p-number of output signals $Z_{n1}$ (where n=1 to p) and p-number of output signals $Z_{nq}$ (where n=1 to p), respectively. Similarly, the 1st one of the p-number of rows arranged in the direction of Y-axis produce q-number of output signals $Z_{1m}$ (where m=1 to q), while the p-th row produce q-number of output signals $Z_{pm}$ (where m=1 to q).

Figure 6:
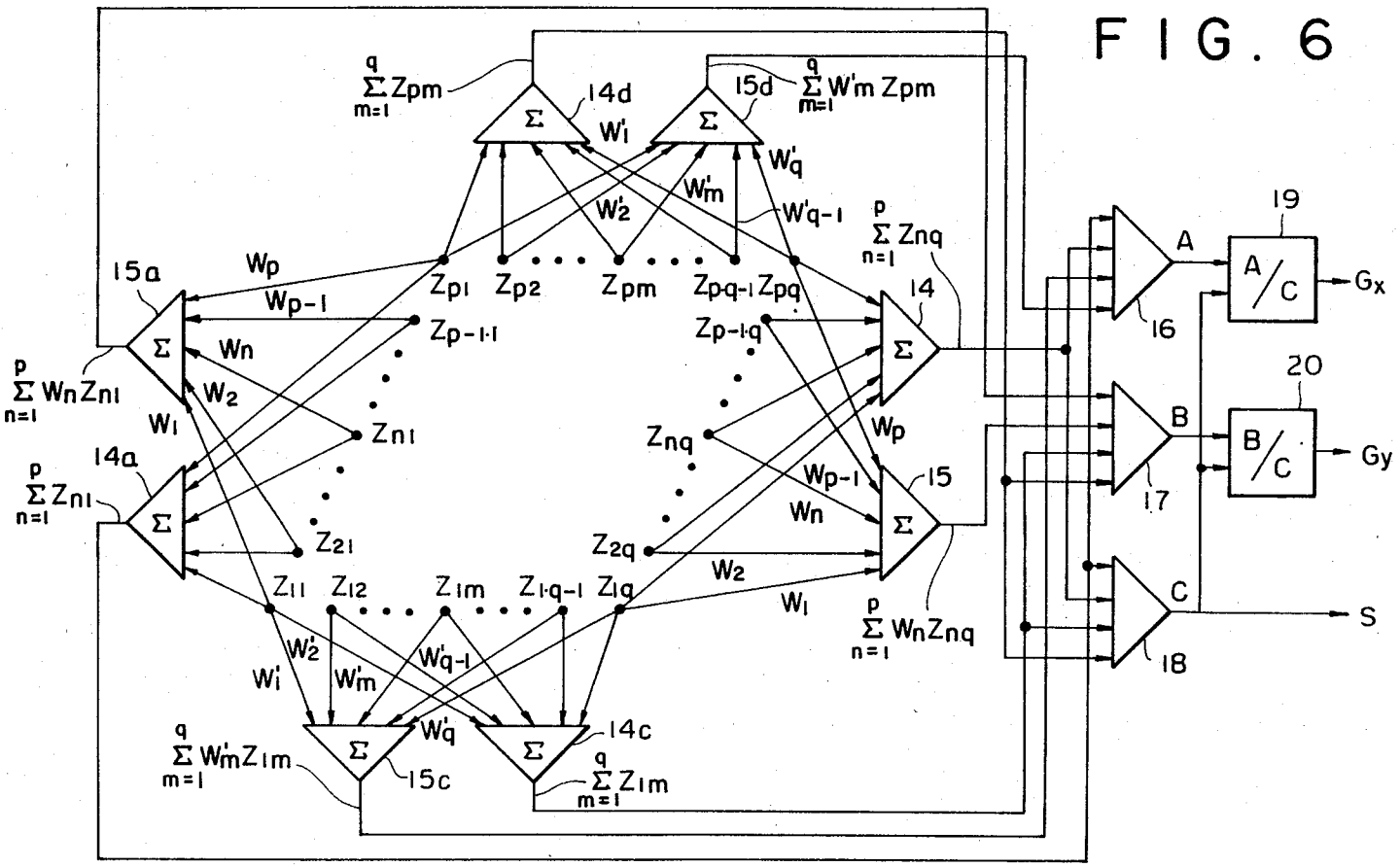
FIG. 6 is a circuit diagram similar to FIG. 3 receiving the outputs from the circuit of FIG. 5 for generating outputs indicative of the center position and the total sum.
Figure 6A:
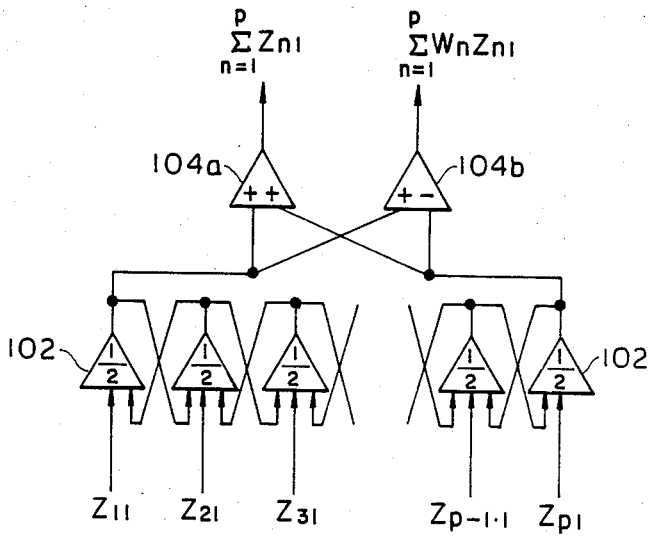

As shown in FIG. 6, the arithmetic circuit which is connected in a stage subsequent to the above-described processing circuits is provided with adders 14*a* to 14*d*, which respectively receive the output signals $Z_{n1}$ (n=1 to p) and $Z_{nq}$ (n−1 to p) of the adders corresponding to the sensors in the opposite end positions of the columns arranged in the direction of X-axis, namely, the sensors in the 1st and q-th columns, as well as the output signals $Z_{1m}$ (m=1 to q) and $Z_{pm}$ (m=1 to q) of the adders corresponding to the sensors in the opposite end positions of the rows arranged in the direction of Y-axis, namely, the sensors in the 1st and p-th rows, and which produce the sums $$\sum_{n=1}^{p} Z_{n1},\ \sum_{n=1}^{p} Z_{nq},\ \sum_{m=1}^{q} Z_{1m} \text{ and } \sum_{m=1}^{q} Z_{pm}$$

as their output signals, respectively. The arithmetic circuit further includes adders 15*a* to 15*d* which produce the total sums $$\sum_{n=1}^{p} W_n Z_{n1} \text{ and } \sum_{n=1}^{p} W_n Z_{nq}$$

where $W_n$ is a coefficient expressed by:

$$W_n = \frac{p-2n+1}{p+1}$$

and the total sums $$\sum_{m=1}^{q} W_m' Z_{1m} \text{ and } \sum_{m-1}^{q} W_m' Z_{pn}$$

where $W'_m$ is a coefficient expressed by:

$$W_m' = \frac{q-2m+1}{q+1}$$

Further, the arithmetic circuit is provided with a calculator 16 which receives the output signals of the adders 14*a* 14*b*, 15*c* and 15*d* to produce the following output A, a calculator 17 which receives the output signals of the adders 15*a* 15*b*, 14*c* and 14*d* to produce the following output B, and a calculator 18 which receives the output signals of the adders 14*a* to 14*d* to produce the following output C.

$$A = -\sum_{n=1}^{p} Z_{n1} + \sum_{n=1}^{p} Z_{nq} + \sum_{m=1}^{q} W_m' Z_{1m} + \sum_{m=1}^{q} W_n' Z_{pm}$$

$$B = -\sum_{m=1}^{q} Z_{1m} + \sum_{m=1}^{q} Z_{pm} + \sum_{n=1}^{p} W_m Z_{n1} + \sum_{n=1}^{p} W_m Z_{nq}$$

$$C = \sum_{n=1}^{p} Z_{n1} + \sum_{n=1}^{p} Z_{nq} + \sum_{m=1}^{q} Z_{1m} + \sum_{m=1}^{q} Z_{pm}$$

The output signals of the calculators 16 and 18 are fed to a divider 19, while the output signals of the calculator 17 and 18 are fed to a divider 20. The dividers 19 and 20 divide the output signals A and B of the calculators 16 and 17 by the output signal C of the calculator 18, respectively. The output signals of the dividers 19 and 20 indicate the X- and Y-axis coordinates $G_x$ and $G_y$, expressed by Equations (1) and (2), of the center (centroid) position of two-dimensional data distribution such as of an applied load. The output signal of the calculator 18 indicates the total sum S of the output signals of the respective sensors 2. Similarly to the foregoing embodiment, the coordinates ($G_x$, $G_y$) of the centroid are indicated in terms of the orthogonal coordinates on the X- and Y-axes with an origin at $$\left(\frac{1+q}{2}, \frac{1+p}{2}\right).$$

In this embodiment, too, the adders 14*a*–*14d* and 15*a*–*15d* may be constituted by a circuit similar to that shown in FIG. 3(*a*). FIG. 6(*a*) shows an example of such a circuit for the calculation of the sums $$\sum_{n=1}^{p} Z_{n1} \text{ and } \sum_{n=1}^{p} W_n Z_{n1}.$$

The p×1 matrix formed of a row of adders 102 similar to adders 2*a* of FIG. 3(*a*) receives output signals $Z_{n1}$ (n=1 to p) from the adders 8 receiving the output signals $R_{n1}$ from the sensors. The adders 102 positioned at both ends of the p×1 matrix are coupled to adders 104*a* and 104*b* for the generation the sum of their output and the difference of their input, respectively. The sum is identical with the sum $$\sum_{n=1}^{p} Z_{n1}$$

and the difference is identical with the sum $$\sum_{n=1}^{p} W_n Z_{n1}.$$

The adders 14*b* and 15*b*, 14*c* and 15*c*, 14*d* and 15*d* may also be constituted in the same manner as described above.

Figure 7:
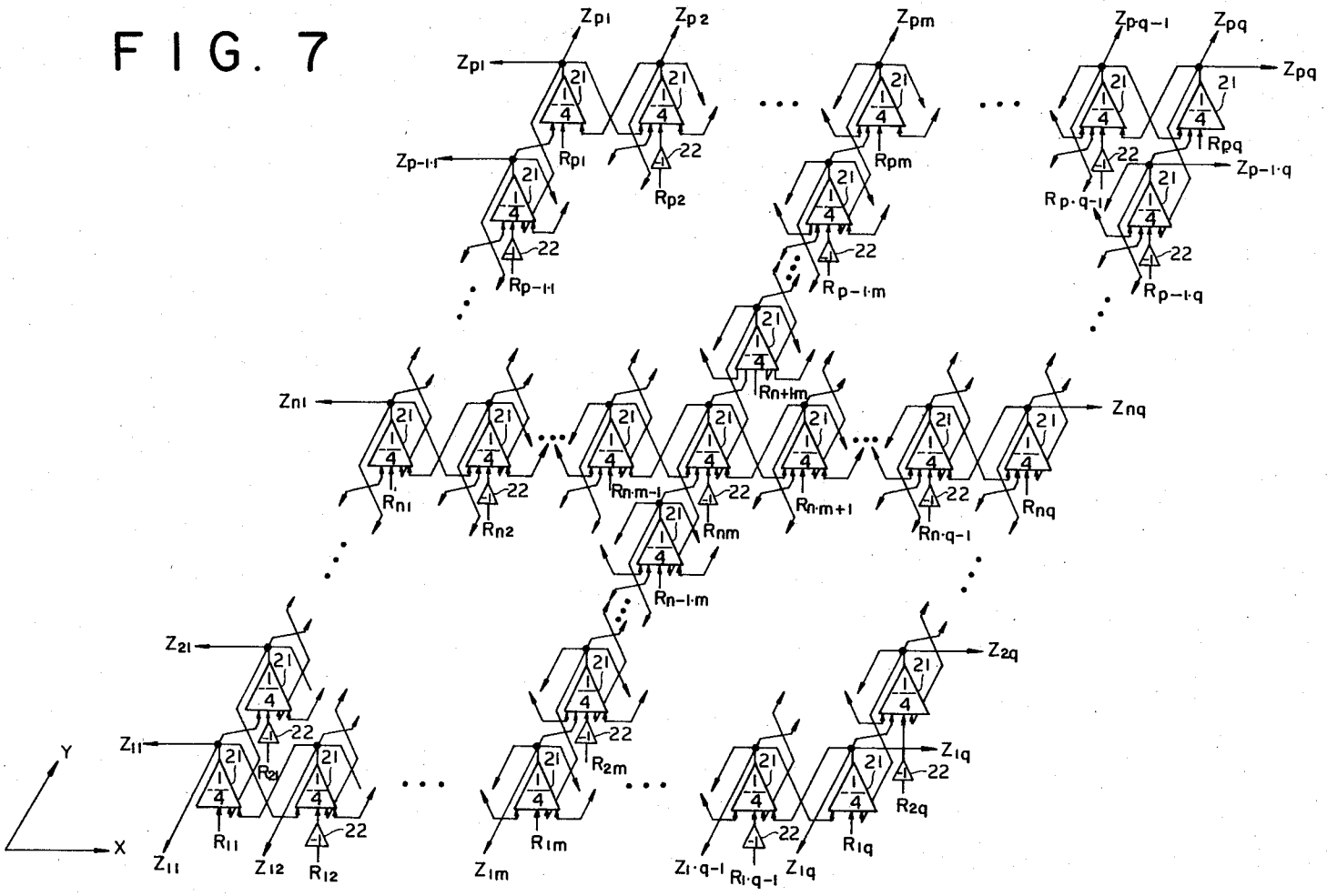
FIG. 7 is a circuit diagram similar to FIG. 4 showing an alternate embodiment of FIG. 5.
Figure 7A:
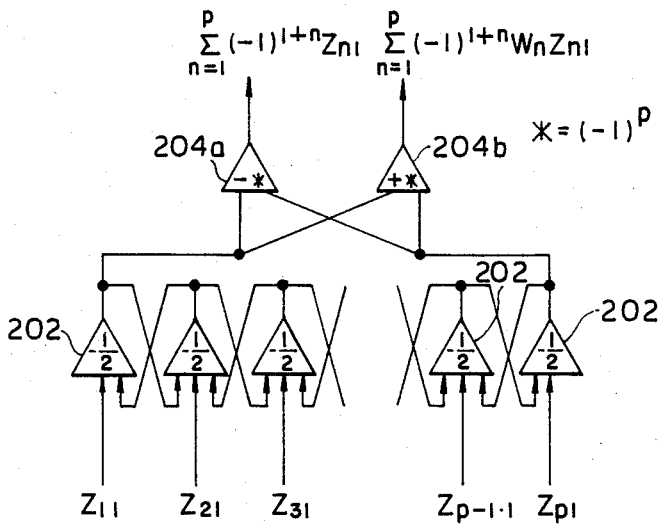
Figure 7B:
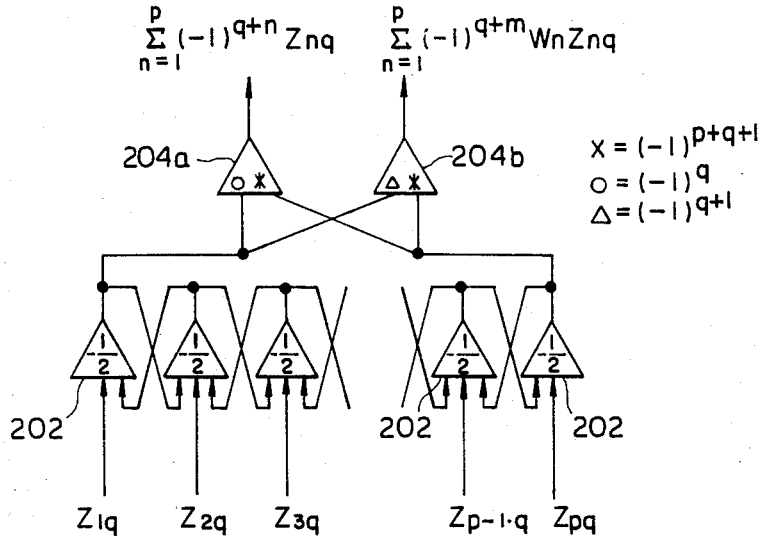
Figure 7C:
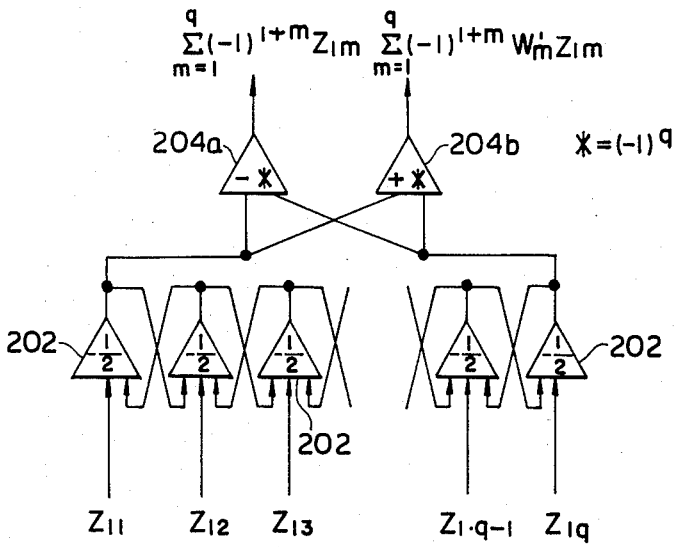
Figure 7D:
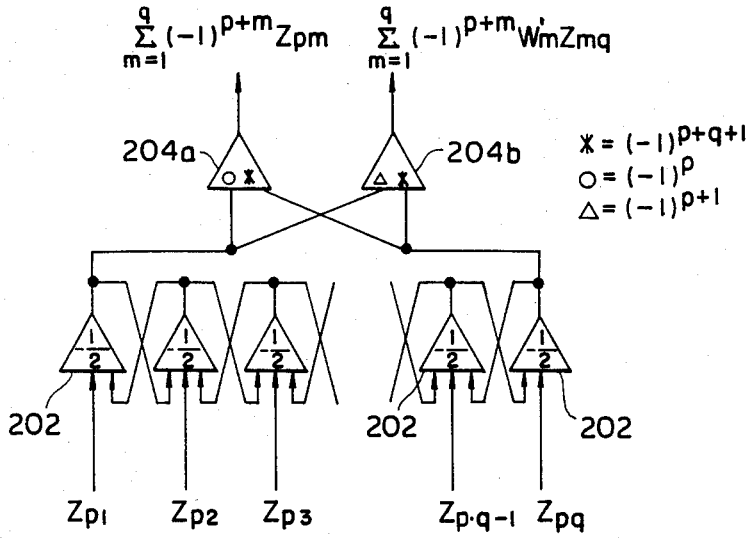

Referring now to FIG. 7, there is shown a modification which is developed from the embodiment of FIG. 5 in a manner similar to the modification of FIG. 4 derived from the embodiment of FIG. 2. More specifically, instead of the non-inversion type adders 8 in the embodiment of FIG. 5, the modification of FIG. 7 employs adders 21 of an inversion type which produces an inverted output signal, i.e. $-\frac{1}{4}$ of the sum of the respective input signals. The adders 21 in the positions where n+m is an odd number are supplied with a signal from a sensor through an inverting amplifier 22. In this instance, the output signals of the above-described processing circuit are fed to an arithmetic circuit as shown in FIG. 6 to calculate the coordinates of the center position and the total sum, with the adders 16 to 18 arranged to produce the following output signals respectively:

$$A: -\sum_{n=1}^{p}(-1)^{n+1}Z_{n1} + \sum_{n=1}^{p}(-1)^{n+q}Z_{nq} + \sum_{m=1}^{q}(-1)^{1+m}W_m'Z_{1m} + \sum_{m=1}^{q}(-1)^{p+m}W_m'Z_{pm}$$

$$B: -\sum_{m=1}^{q}(-1)^{m+1}Z_{1m} + \sum_{m=1}^{q}(-1)^{m+p}Z_{pm} + \sum_{n=1}^{p}(-1)^{1+n}W_nZ_{n1} + \sum_{n=1}^{p}(-1)^{n+q}W_nZ_{nq}$$

$$C: \sum_{n=1}^{p}(-1)^{n+1}Z_{n1} + \sum_{n=1}^{p}(-1)^{n+q}Z_{nq} + \sum_{m=1}^{q}(-1)^{1+m}Z_{1m} + \sum_{m=1}^{q}(-1)^{p+m}Z_{pm}$$

Preferred embodiments of the arithmetic circuits for the calculation of $$\sum_{n=1}^{p}(-1)^{1+n}Z_{n1} \text{ and } \sum_{n=1}^{p}(-1)^{1+n}W_nZ_{n1};\ \sum_{n=1}^{p}(-1)^{q+n}Z_{nq} \text{ and } \sum_{n=1}^{p}(-1)^{q+n}W_nZ_{nq};\ \sum_{m=1}^{q}(-1)^{1+m}Z_{1m} \text{ and } \sum_{m=1}^{q}(-1)^{1+m}W_m'Z_{1m};\ \text{and } \sum_{m=1}^{q}(-1)^{p+m}Z_{pm} \text{ and } \sum_{m=1}^{q}W_m'Z_{mq}$$

are, respectively, shown in FIGS. 7(*a*)–7(*d*). As shown in FIGS. 7(*a*)–7(*d*), each circuit includes a p×1 or 1×q matrix of adders 202 each of an inversion type receiving output $Z_{n1}$ (n=1 to p), $Z_{nq}$ (n=1 to p), $Z_{1m}$ (m=1 to q) of $Z_{pm}$ (m=1 to q). The outputs from the adders 202 located at both ends of the matrix are fed to adders 204*a* and 204*b* for the calculation of the sum thereof or difference therebetween, generating such outputs as shown in FIGS. 7(*a*)–7(*d*).

As will be appreciated from the foregoing, the center position-detecting device according to the present invention is composed of simple repetition of the same unit circuit so that the whole circuit may be formed by a large scale integrated circuit. Therefore, the detecting device may be advantageously utilized as a tactile sensor of a robot for obtaining information concerning position, shape, amount (such as intensity of contact pressure), etc. In a conventional technique, such an information is obtained after collecting the data from sensors in a computor for processing. With the "intelligent" device of the present invention, in contrast, the information is obtained locally so that the entire system becomes simple and compact.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

I claim:

1. A device for detecting the center position ($G_x$, $G_y$) of two-dimensionally distributed data $R_{nm}$, where n and m are integers of 1 to p and 1 to q, respectively, said data being the outputs from a p×q matrix of sensors with q-number of first to q-th columns arranged in the direction of the X-axis and p-number of first to p-th rows in the direction of the Y-axis, wherein $G_x$ and $G_y$ are expressed as:

$$G_x = \frac{\sum_{m=1}^{q}\sum_{n=1}^{p}(q-2m+1)R_{nm}}{\left(\sum_{m=1}^{q}\sum_{n=1}^{p}R_{nm}\right)(q+1)}$$

$$G_y = \frac{\sum_{m=1}^{q}\sum_{n=1}^{p}(p-2n+1)R_{nm}}{\left(\sum_{m=1}^{q}\sum_{n=1}^{p}R_{nm}\right)(p+1)}$$

said device comprising:

p×q number of first adders respectively coupled with the sensors for receiving the outputs $R_{nm}$ from their corresponding sensors as part of their respective inputs and arranged such that each first adder receives as the remainder of its inputs the outputs of the first adders whose corresponding sensors are positioned in the same row of its corresponding sensor and adjacent thereto, with the outputs $X_{nm}$ generated from the first adders being each a half of their respective total inputs;

p×q number of second adders respectively coupled with sensors for receiving the output $R_{nm}$ from their corresponding sensors as part of their respective inputs and arranged such that each second adder receives as the remainder of its inputs the outputs of the second adders whose corresponding sensors are positioned in the same column of its corresponding sensor and adjacent thereto, with the outputs $Y_{nm}$ generated from the second adders being each a half of their respective total inputs;

first calculating means, coupled with p-number of the first adders whose corresponding sensors are located at the first column, for receiving their outputs $X_{n1}$ and for generating an output which is the sum of its input $$\sum_{n=1}^{p} X_{n1};$$

second calculating means, coupled with p-number of the first adders whose corresponding sensors are located at the q-th column, for receiving their outputs $X_{nq}$ and for generating an output which is the sum of its inputs $$\sum_{n=1}^{p} X_{nq};$$

third calculating means, coupled with q-number of the second adders whose corresponding sensors are located at the first row, for receiving their outputs $Y_{1m}$ and for generating an output which is the sum of its inputs $$\sum_{m=1}^{q} Y_{1m};$$

fourth calculating means, coupled with q-number of the second adders whose corresponding sensors are located at the p-th row, for receiving their outputs $Y_{pm}$ and for generating an output which is the sum of its inputs $$\sum_{m=1}^{q} Y_{pm};$$

first means coupled to the first and second calculating means for generating an output of a first value:

$$\frac{\sum_{n=1}^{p} X_{nq} - \sum_{n=1}^{p} X_{n1}}{\sum_{n=1}^{p} X_{n1} + \sum_{n=1}^{p} X_{nq}}; \text{ and}$$

second means coupled to the second and third calculating means for generating an output of a second value:

$$\frac{\sum_{m=1}^{q} Y_{pm} - \sum_{m=1}^{q} Y_{1m}}{\sum_{m=1}^{q} Y_{1m} + \sum_{m=1}^{q} Y_{pm}}$$

wherein said first and second values are equal to $G_x$ and $G_y$, respectively.

2. A device as set forth in claim 1, wherein said first means also generates a third output of a third value:

$$\sum_{n=1}^{p} X_{n1} + \sum_{n=1}^{p} X_{nq}$$

wherein said third value is equal to the sum of the data $R_{nm}$.

3. A device for detecting the center position ($G_x$, $G_y$) of two-dimensionally distributed data $R_{nm}$, where n and m are integers of 1 to p and 1 to q, respectively, said data being the outputs from a p×q matrix of sensors with q-number of first to q-th columns arranged in the direction of the X-axis and p-number of first to p-th rows in the direction of the Y-axis, wherein $G_x$ and $G_y$ are expressed as:

$$G_x = \frac{\sum_{m=1}^{q} \sum_{n=1}^{p} (q - 2m + 1) R_{nm}}{\left(\sum_{m=1}^{q} \sum_{n=1}^{p} R_{nm}\right) (q + 1)}$$

$$G_y = \frac{\sum_{m=1}^{q} \sum_{n=1}^{p} (p - 2n + 1) R_{nm}}{\left(\sum_{m=1}^{q} \sum_{n=1}^{p} R_{nm}\right) (p + 1)}$$

said device comprising: p×q number of first adders respectively coupled with the sensors for receiving the outputs $R_{nm}$ from their corresponding sensors as part of their respective inputs and arranged such that each first adder receives as the remainder of its inputs the outputs of the first adders whose corresponding sensors are positioned in the same row of its corresponding sensor and adjacent thereto, wherein the first adders whose corresponding sensors are positioned in the columns of odd numbers receive the outputs from their corresponding sensors in the inverted state, with the outputs $X_{nm}$ generated from the first adders being each an inverted half of their respective total inputs;

p×q number of second adders respectively coupled with sensors for receiving the output $R_{nm}$ from their corresponding sensors as part of their respective inputs and arranged such that each second adder receives as the remainder of its inputs the outputs of the second adders whose corresponding sensors are positioned in the same column of its corresponding sensor and adjacent thereto, wherein the second adders whose corresponding sensors are positioned in the rows of odd numbers receive the outputs from their corresponding sensors in the invented state, with the output $Y_{nm}$ generated from the second adders being each an inverted half of their respective total inputs;

first calculating means, coupled with p-number of the first adders whose corresponding sensors are located at the first column, for receiving their outputs $X_{n1}$ and for generating an output which is the sum of its input $$\sum_{n=1}^{p} X_{n1};$$

second calculating means, coupled with p-number of the first adders whose corresponding sensors are located at the q-th column, for receiving their outputs $X_{nq}$ and for generating an output which is the sum of its inputs $$\sum_{n=1}^{p} X_{nq};$$

third calculating means, coupled with q-number of the second adders whose corresponding sensors are located at the first row, for receiving their outputs $Y_{1m}$ and for generating an output which is the sum of its inputs $$\sum_{m=1}^{q} Y_{1m};$$

fourth calculating means, coupled with q-number of the second adders whose corresponding sensors are located at the p-th row, for receiving their outputs $Y_{pm}$ and for generating an output which is the sum of its inputs $$\sum_{m=1}^{q} Y_{pm};$$

first means coupled to the first and second calculating means for generating an output of a first value:

$$\frac{\sum_{n=1}^{p} X_{nq} - \sum_{n=1}^{p} X_{n1}}{\sum_{n=1}^{p} X_{n1} + \sum_{n=1}^{p} X_{nq}}$$

when q is an odd number or $$\frac{\sum_{n=1}^{p} X_{n1} + \sum_{n=1}^{p} X_{nq}}{\sum_{n=1}^{p} X_{nq} - \sum_{n=1}^{p} X_{n1}}$$

when q is an even number, and second means coupled to the second and third calculating means for generating an output of a second value:

$$\frac{\sum_{m=1}^{q} Y_{pm} - \sum_{m=1}^{q} Y_{1m}}{\sum_{m=1}^{q} Y_{pm} + \sum_{m=1}^{q} Y_{1m}}$$

when p is an odd number or $$\frac{\sum_{m=1}^{q} Y_{1m} + \sum_{m=1}^{q} Y_{pm}}{\sum_{m=1}^{q} Y_{pm} - \sum_{m=1}^{q} Y_{1m}}$$

when p is an even number, wherein said first and second values are equal to $G_x$ and $G_y$, respectively.

4. A device as set forth in claim 3, wherein said first means also generates a third output of a third value:

$$-\sum_{n=1}^{p} X_{n1} + (-)^q \sum_{n=1}^{p} X_{nq}$$

wherein said third value is equal to the sum of the data $R_{nm}$.

5. A device for detecting the center position ($G_x$, $G_y$) of two-dimensionally distributed data $R_{nm}$, where n and m are integers of 1 to p and 1 to q, respectively, said data being the outputs from a p×q matrix of sensors with q-number of first to q-th columns arranged in the direction of the X-axis and p-number of first to p-th rows, in the direction of the Y-axis, wherein $G_x$ and $G_y$ are expressed as:

$$G_x = \frac{\sum_{m=1}^{q} \sum_{n=1}^{p} (q - 2m + 1) R_{nm}}{\left(\sum_{m=1}^{q} \sum_{n=1}^{p} R_{nm}\right) (q + 1)}$$

$$G_y = \frac{\sum_{m=1}^{q} \sum_{n=1}^{p} (p - 2n + 1) R_{nm}}{\left(\sum_{m=1}^{q} \sum_{n=1}^{p} R_{nm}\right) (p + 1)}$$

said device comprising:

p×q number of adders respectively coupled with the sensors for receiving the outputs $R_{nm}$ from their corresponding sensors as part of their respective inputs and arranged such that each adder receives as the remainder of its inputs the outputs of the adders whose corresponding sensors are positioned in the same row and in the same column of its corresponding sensor and adjacent thereto, with the outputs $Z_{nm}$ generated from the adders being each a quarter of their respective total inputs;

first calculating means, coupled with p-number of the first adders whose corresponding sensors are located at the first column, for receiving their outputs $Z_{n1}$ and for generating first and second outputs respectively of values:

$$\sum_{n=1}^{p} Z_{n1} \text{ and } \sum_{n=1}^{p} W_n Z_{n1} \text{ where } W_n = \frac{p - 2n + 1}{p + 1};$$

second calculating means, coupled with p-number of the first adders whose corresponding sensors are located at the q-th column, for receiving their outputs $Z_{nq}$ and for generating third and fourth outputs respectively of values:

$$\sum_{n=1}^{p} Z_{nq} \text{ and } \sum_{n=1}^{p} W_n Z_{nq};$$

third calculating means, coupled with q-number of the second adders whose corresponding sensors are located at the first row, for receiving their outputs $Z_{1m}$ and for generating fifth and sixth outputs respectively of values:

$$\sum_{m=1}^{q} Z_{1m} \text{ and } \sum_{m=1}^{q} W_m' Z_{1m} \text{ where } W_m' = \frac{q - 2m + 1}{q + 1};$$

fourth calculating means, coupled with q-number of the second adders whose corresponding sensors are located at the p-th row, for receiving their outputs $Z_{pm}$ and for generating seventh and eighth outputs respectively of values:

$$\sum_{m=1}^{q} Z_{pm} \text{ and } \sum_{m=1}^{q} W_m' Z_{pm}; \text{ and}$$

arithmetic means coupled with the first to fourth calculating means for receiving the first to eighth outputs and for generating first and second calculated output signals A/C and B/C where $$A = -\sum_{n=1}^{p} Z_{n1} + \sum_{n=1}^{p} Z_{nq} + \sum_{m=1}^{q} W_m' Z_{1m} + \sum_{m=1}^{q} W_n' Z_{pm}$$

$$B = -\sum_{m=1}^{q} Z_{1m} + \sum_{m=1}^{q} Z_{pm} + \sum_{n=1}^{p} W_m Z_{n1} + \sum_{n=1}^{p} W_m Z_{nq}$$

$$C = \sum_{n=1}^{p} Z_{n1} + \sum_{n=1}^{p} Z_{nq} + \sum_{m=1}^{q} Z_{1m} + \sum_{m=1}^{q} Z_{pm}$$

wherein said first and second calculated signals are equal to $G_x$ and $G_y$, respectively.

6. A device as set forth in claim 5, wherein said arithmetic means further generate a third calculated output signal C which is equal to the sum of the data $R_{nm}$.

7. A device for detecting the center position ($G_x$, $G_y$) of two-dimensionally distributed data $R_{nm}$, where n and m are integers of 1 to p and 1 to q, respectively, said data being the outputs from a p×q matrix of sensors with q-number of first to q-th columns arranged in the direction of the X-axis and p-number of first to p-th rows in the direction of the Y-axis, wherein $G_x$ and $G_y$ are expressed as:

$$G_x = \frac{\sum_{m=1}^{q} \sum_{n=1}^{p} (q - 2m + 1) R_{nm}}{\left(\sum_{m=1}^{q} \sum_{n=1}^{p} R_{nm}\right) (q + 1)}$$

$$G_y = \frac{\sum_{m=1}^{q} \sum_{n=1}^{p} (p - 2n + 1) R_{nm}}{\left(\sum_{m=1}^{q} \sum_{n=1}^{p} R_{nm}\right) (p + 1)}$$

said device comprising:

p×q number of adders respectively coupled with the sensors for receiving the outputs $R_{nm}$ from their corresponding sensors as part of their respective inputs and arranged such that each adder receives as the remainder of its inputs the outputs of the adders whose corresponding sensors are positioned in the same row and in the same column of its corresponding sensor and adjacent thereto, wherein the adders, whose corresponding sensors are so positioned as to provide respective sums of n and m being odd numbers, receive the outputs from their corresponding sensors in the inverted state, with the outputs $Z_{nm}$ generated from the adders being each an inverted quarter of their respective total inputs;

first calculating means, coupled with p-number of the first adders whose corresponding sensors are located at the first column, for receiving their outputs $Z_{n1}$ and for generating first and second outputs respectively of values:

$$\sum_{n=1}^{p} Z_{n1} \text{ and } \sum_{n=1}^{p} W_n Z_{n1} \text{ where } W_n = \frac{p - 2n + 1}{p + 1};$$

second calculating means, coupled with p-number of the first adders whose corresponding sensors are located at the q-th column, for receiving their outputs $Z_{nq}$ and for generating third and fourth outputs respectively of values:

$$\sum_{n=1}^{p} Z_{nq} \text{ and } \sum_{n=1}^{p} W_n Z_{nq};$$

third calculating means, coupled with q-number of the second adders whose corresponding sensors are located at the first row, for receiving their outputs $Z_{1m}$ and for generating fifth and sixth outputs respectively of values:

$$\sum_{m=1}^{q} Z_{1m} \text{ and } \sum_{m=1}^{q} W_m' Z_{1m} \text{ where } W_m' = \frac{q - 2m + 1}{q + 1};$$

fourth calculating means, coupled with q-number of the second adders whose corresponding sensors are located at the p-th row, for receiving their outputs $Z_{pm}$ and for generating seventh and eighth outputs respectively of values:

$$\sum_{m=1}^{q} Z_{pm} \text{ and } \sum_{m=1}^{q} W_m' Z_{pm}; \text{ and}$$

arithmetic means coupled with the first to fourth calculating means for receiving the first to eighth outputs and for generating first and second calculated output signals A/C and B/C where $$A = -\sum_{n=1}^{p} (-1)^{n+1} Z_{n1} + \sum_{n=1}^{p} (-1)^{n+q} Z_{nq} + \sum_{m=1}^{q} (-1)^{1+m} W_m' Z_{1m} + \sum_{m=1}^{q} (-1)^{p+m} W_m' Z_{pm}$$

$$B = -\sum_{m=1}^{q} (-1)^{m+1} Z_{1m} + \sum_{m=1}^{q} (-1)^{m+p} Z_{pm} + \sum_{n=1}^{p} (-1)^{1+n} W_n Z_{n1} + \sum_{n=1}^{p} (-1)^{n+q} W_n Z_{nq}$$

$$C = \sum_{n=1}^{p} (-1)^{n+1} Z_{n1} + \sum_{n=1}^{p} (-1)^{n+q} Z_{nq} + \sum_{m=1}^{q} (-1)^{1+m} Z_{1m} + \sum_{m=1}^{q} (-1)^{p+m} Z_{pm}$$

wherein said first and second calculated signals are equal to $G_x$ and $G_y$, respectively.

8. A device as set forth in claim 7, wherein said arithmetic means further generate a third calculated output signal C which is equal to the sum of the data $R_{nm}$.

* * * * *

UNITED STATES PATENT AND TRADEMARK OFFICE

CERTIFICATE OF CORRECTION

PATENT NO. : 4,551,817

DATED : November 5, 1985

INVENTOR(S) : Masatoshi ISHIKAWA

It is certified that error appears in the above—identified patent and that said Letters Patent is hereby corrected as shown below:

Col. 3, line 28, "respec- tively" should read --respectively--.

Col. 13, line 15, (in the definition of "B" in claim 5) "$W_mZ_{nq}$" should read --$W_nZ_{nq}$--.

Signed and Sealed this

Sixth Day of May 1986

[SEAL]

*Attest:*

DONALD J. QUIGG

*Attesting Officer*

*Commissioner of Patents and Trademarks*